US006375533B1

(12) United States Patent
Torikai et al.

(10) Patent No.: US 6,375,533 B1
(45) Date of Patent: Apr. 23, 2002

(54) ELECTRICITY LEAD-IN BODY FOR BULB AND METHOD FOR MANUFACTURING THE SAME

(75) Inventors: Tetuya Torikai, Fukuoka; Yukihiro Morimoto, Mishima; Toyohiko Kumada, Himeji; Yukiharu Tagawa, Himeji; Kenzo Kai, Himeji; Hiroshi Sugahara, Himeji; Shigenori Nozawa, Himeji, all of (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/403,789

(22) PCT Filed: Mar. 3, 1999

(86) PCT No.: PCT/JP99/01003

§ 371 Date: Jan. 12, 2000

§ 102(e) Date: Jan. 12, 2000

(87) PCT Pub. No.: WO99/45570

PCT Pub. Date: Sep. 10, 1999

(30) Foreign Application Priority Data

Mar. 5, 1998 (JP) ..... 10-69283

(51) Int. Cl.[7] ..... H01J 17/18
(52) U.S. Cl. ..... 445/26; 445/43; 313/625
(58) Field of Search ..... 445/26, 43; 313/625

(56) References Cited

U.S. PATENT DOCUMENTS

| | | | | |
|---|---|---|---|---|
| 5,532,552 A | * | 7/1996 | Heider et al. | 313/625 |
| 5,552,670 A | * | 9/1996 | Heider et al. | 313/625 |
| 5,592,049 A | * | 1/1997 | Heider et al. | 313/625 |
| 5,742,123 A | * | 4/1998 | Nagayama | 313/625 |
| 6,107,740 A | * | 8/2000 | Morimoto et al. | 313/625 |
| 6,224,449 B1 | * | 5/2001 | Niimi et al. | 445/26 |

FOREIGN PATENT DOCUMENTS

| | | | |
|---|---|---|---|
| EP | 930639 A1 | * | 7/1999 |
| JP | 10-188897 | | 7/1998 |
| JP | 11-25915 | | 1/1999 |
| WO | WO-9406947 A1 | * | 3/1994 |

OTHER PUBLICATIONS

Microfilm of the Specification and Drawings Annexed to the Request of Japanese Utility Model Application No. 62–53426 (Laid–Open No. 63–160662), Toshiba Corp., Oct. 20, 1988 Specification as a Whole.

* cited by examiner

*Primary Examiner*—Kenneth J. Ramsey
(74) *Attorney, Agent, or Firm*—Nixon Peabody LLP; David S. Safran

(57) ABSTRACT

The object of the invention to devise an electrical insertion body for a tube lamp in which sealing bodies of an electrically conductive inorganic material component and a dielectric inorganic material component and upholding parts of the electrodes are attached securely to one another by sintering, and in which neither leaks nor falling out of the upholding parts of the electrodes occur. The object is achieved as claimed in the invention, in an electrical insertion body for a tube lamp in which an upholding part of the electrode is inserted into the center opening of a respective sealing body of a functional gradient material for a tube lamp, in that in the boundary areas between the sealing bodies and the upholding parts of the electrodes one diffusion area at a time is formed, in which the electrically conductive inorganic material component of the sealing body, the metallic component of the upholding part of the electrode and a diffusion accelerator are present diffused into one another, which at the sintering temperature accelerates diffusion of the electrically conductive inorganic material component of the sealing body and of the metallic component of the upholding part of the electrode and that in this way the upholding part of the electrode and the electrically conductive inorganic material component of the sealing body are joined to one another.

3 Claims, 5 Drawing Sheets

| No | $SiO_2$ (wt%) | Mo (wt%) | Ni (wt%) | Thickness of layer (mm) |
|---|---|---|---|---|
| 1 | 100 | 0 | 0 | 3 |
| 2 | 97.5 | 2.5 | 0 | 1 |
| 3 | 95 | 5 | 0 | 0.5 |
| 4 | 90 | 10 | 0 | 0.3 |
| 5 | 85 | 15 | 0 | 0.3 |
| 6 | 80 | 20 | 0 | 0.3 |
| 7 | 70 | 30 | 0 | 0.3 |
| 8 | 60 | 40 | 0 | 0.3 |
| 9 | 50 | 47.5 | 2.5 | 0.5 |
| 10 | 45 | 52.2 | 2.8 | 0.5 |
| 11 | 35 | 61.7 | 3.3 | 4 |
| 12 | 25 | 75 | 0 | 5 |

Fig. 7

| Ni (wt%) | Probability of a leak forming (%) |
|---|---|
| 0 | 100 |
| 3 | 80 |
| 5 | 0 |
| 10 | 0 |
| 20 | 20 |

Fig. 8

| No | $SiO_2$ (wt%) | Mo (wt%) | Cr (wt%) | Thickness of layer (mm) |
|---|---|---|---|---|
| 1 | 100 | 0 | 0 | 3 |
| 2 | 97.5 | 2.5 | 0 | 1 |
| 3 | 95 | 5 | 0 | 0.5 |
| 4 | 90 | 10 | 0 | 0.3 |
| 5 | 85 | 15 | 0 | 0.3 |
| 6 | 80 | 20 | 0 | 0.3 |
| 7 | 70 | 30 | 0 | 0.3 |
| 8 | 60 | 40 | 0 | 0.3 |
| 9 | 50 | 48.5 | 2.0 | 0.5 |
| 10 | 45 | 52.7 | 2.3 | 0.5 |
| 11 | 35 | 62.3 | 2.7 | 4 |
| 12 | 25 | 75 | 0 | 5 |

ELECTRICITY LEAD-IN BODY FOR BULB AND METHOD FOR MANUFACTURING THE SAME

TECHNICAL FIELD

The invention relates to an electrical insertion body for a tube lamp which seals a sealing tube of a tube lamp, such as a mercury lamp, a metal halide lamp, a halogen lamp or the like. The invention furthermore relates to a production process for the electrical insertion body. The expression "electrical insertion body for a tube lamp" is defined as an arrangement in which a sealing body is combined with an upholding part of the electrode.

DESCRIPTION OF RELATED ART

In a tube lamp, for example a high pressure discharge lamp, in a spherical or oval fused silica glass arc tube there are a pair of electrodes opposite one another and the tube is filled with an emission metal such as mercury or the like, discharge gas and the like. Cylindrical sealing tubes are connected to the ends of the arc tube. Upholding parts of the electrodes with tips each provided with an electrode, and outer lead pins are electrically connected by these sealing tubes and are sealed in this state. Since however the upholding parts of the electrodes of tungsten and the sealing tubes of fused silica glass have very different coefficients of thermal expansion, the sealing tubes cannot be directly welded to the upholding parts of the electrodes and sealed.

The sealing tubes were therefore conventionally sealed by a foil sealing process, a step joining process or the like. In the step joining process several types of glass with different coefficients of thermal expansion are joined to one another. Recently it has become more and more important to seal sealing tubes which are connected to the ends of the arc tubes using sealing bodies which consist of a functional gradient material which consists of a dielectric inorganic material component such as silicon dioxide or the like and of an electrically conductive inorganic material component such as molybdenum or the like and which is made essentially columnar.

In this sealing body one end is rich in the dielectric inorganic material component such as silicon dioxide or the like and in the direction to the other end the proportion of electrically conductive inorganic material component such as molybdenum or the like increases continuously or in steps.

In a sealing body of a functional gradient material which is formed from silicon dioxide and molybdenum, therefore the vicinity of one end of the sealing body contains a large amount of silicon dioxide, is dielectric and has a coefficient of thermal expansion which is roughly equal to that of the fused silica glass, while the vicinity of the other end contains a large amount of molybdenum, is electrically conductive and has the property that its coefficient of thermal expansion approaches that of the molybdenum.

Since in this sealing body of a functional gradient material the gradient of the change of the ratio of the dielectric inorganic material component to the electrically conductive inorganic material component can be increased, the one face side has a large proportion of the dielectric inorganic material component while the other face side can have a large proportion of the electrically conductive inorganic material component, even if the sealing body is not long in its axial direction.

The functional gradient material has no interface on which the composition of its material components changes significantly. The functional gradient material is therefore resistant to thermal shock and has high mechanical strength. Therefore the locations to be sealed at which the sealing tubes and the sealing bodies are welded to one another approach the center area of the arc tube which reaches a high temperature during operation. Therefore there is the advantage that the length of the sealing tubes can be decreased, the short length of the sealing tubes in the axial direction also contributing to this advantage.

If the sealing body is formed from a functional gradient material of the electrically conductive inorganic material component and the dielectric inorganic material component, the following is done.

First a binder is added to these powders. By pressing it in a casting mold a columnar compact is obtained which is temporarily sintered at a temperature of roughly 1300° C. In this way a temporarily sintered body is obtained.

Next, drilling is done to produce a center opening which is used to insert the upholding part of the electrode into the center axis of this temporarily sintered body.

Alternatively, pressing is done in a casting mold with a projecting component for forming the center opening. Thus a compact with a center opening produced beforehand is obtained. It is temporarily sintered. The upholding part of the electrode is inserted into the center opening of the temporarily sintered body. Afterwards complete sintering is done at a temperature of roughly 1750° C.

Since these materials shrink during sintering of the functional gradient material by 10 to 20%, it is necessary for the center opening of the temporarily sintered body to be made larger than the outside diameter of the upholding part of the electrode. If here the size of the center opening is not enough, during complete sintering in the functional gradient material a stress forms around the upholding part of the electrode, as does subsequent cracking. Therefore the center opening must be made somewhat larger than a stipulated value and in this way cracking is prevented even if the functional gradient material shrinks due to complete sintering.

In this case the disadvantage was the following:

Due to variations of the diameter of the center opening, variations of contraction during complete sintering and for similar reasons the upholding parts of the electrodes are not arranged stably enough on the sealing bodies to tightly adjoin one another. In the case of a through opening in which this center opening penetrates one face side of the sealing body as far as its other face side, the hermetic adhesion property is inadequate. Therefore, after complete sintering on the side of the sealing body from which the upholding part of the electrode projects glass or brazing filler metal is applied as a deposit and thus leaking is prevented, this side projecting from the tube lamp to the outside. Furthermore, in this way the attachment of the upholding parts of the electrode in the sealing bodies was ensured. In this process however there was the disadvantage that the working steps increased and production required high expense.

Furthermore, in the case of a center opening which extends from one face side of the sealing body by a stipulated distance and which is therefore not made continuous, there was no problem of leakage, but there was the disadvantage that as a result of inadequate attachment the upholding parts of the electrodes fall out due to vibration or the like, or similar defects. In this case it was also necessary to take some measures to ensure attachment of the sealing bodies to the upholding parts of the electrodes after complete sintering.

SUMMARY OF THE INVENTION

Therefore the object of the invention to devise an electrical insertion body for a tube lamp in which an upholding part of the electrode is securely attached by sintering into the center opening of a sealing body of an electrically conductive inorganic material component and a dielectric inorganic material component and in which neither leaks nor falling out of the upholding parts of the electrodes occur. Furthermore the object of the invention is to devise a production process for this.

The object is achieved in the invention in an electrical insertion body for a tube lamp for hermetic sealing of the sealing tubes which are connected to the arc tube of the tube lamp in that there are sealing bodies for the tube lamp in which one upholding part of the electrode at a time is inserted into the center opening which is provided in the sintered functional gradient material which consists of an electrically conductive inorganic material component and of a dielectric inorganic material component and which is shaped in the form of a multilayer column such that the ratio of the two components changes gradually in the axial direction, that in the boundary areas between the above described sealing bodies and the upholding parts of the electrodes one diffusion area at a time is formed, in which the electrically conductive inorganic material component of the sealing body, the metallic component of the upholding part of the electrode and a diffusion accelerator are present diffused into one another, which at the sintering temperature of the above described functional gradient material accelerates diffusion of the electrically conductive inorganic material component of the sealing body and of the metallic component of the upholding part of the electrode and that in this way the upholding part of the electrode and the inside of the center opening of the sealing body are joined to one another.

The term "diffusion accelerator" in the invention is defined as a material which, at the sintering temperature of the functional gradient material which forms the sealing body, dissolves in the metallic component of the upholding part of the electrode and also in the electrically conductive inorganic material component of the sealing body and accelerates diffusion of the above described electrically conductive inorganic material component and the electrically conductive inorganic material component of the sealing body into one another.

One such electrical insertion body for a tube lamp is advantageously produced by the process of the present invention.

BRIEF DESCRIPTION OF THE DRAWINGS

FIG. 7 shows a table of one example of the mixing ratio (% by weight) of the respective powders to one another and the thickness (mm) of the respective layer in the case in which nickel is used as the diffusion accelerator;

FIG. 8 shows a schematic of the mixing ratio (% by weight) of the respective powders to one another and the probability that a leak will form;

BEST MODE FOR CARRYING OUT THE INVENTION

Figure 1:
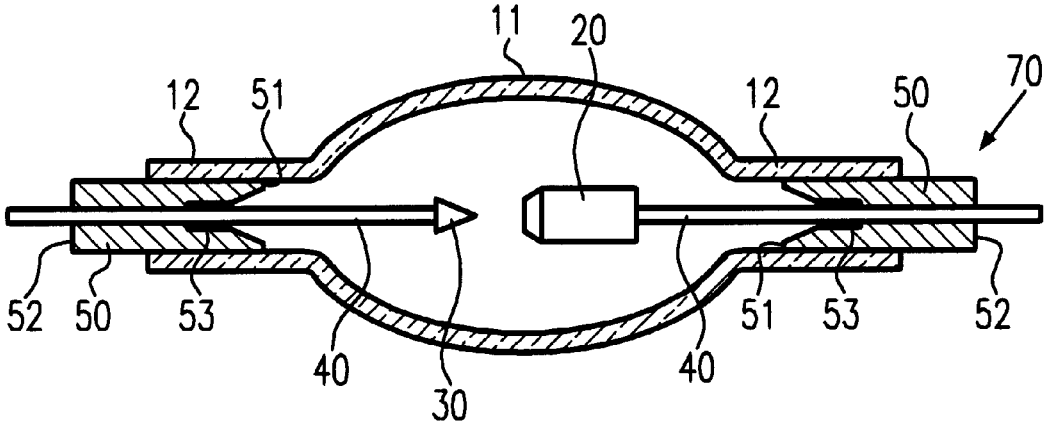
FIG. 1 shows a schematic of a high pressure discharge lamp in which sealing parts of the arc tube are sealed in sealing bodies of a functional gradient material using electrical insertion bodies for a tube lamp which are each penetrated and held by an upholding part of the electrode.

In the following the invention is described using several embodiments shown in the drawings.

FIG. 1 shows an example of a high pressure discharge lamp in which electrical insertion bodies as claimed in the invention are used for a tube lamp which is a short arc xenon lamp with a rated output of 3 kW. The electrical insertion bodies as claimed in the invention for a tube lamp can also be used for another discharge lamp like a mercury lamp, a metal halide lamp, or the like.

In the embodiment of the invention an example is described in which electrical insertion bodies for a tube lamp are used for a discharge lamp. But they can also be used for a filament lamp with a tungsten filament, such as a halogen lamp or the like. In a discharge lamp the upholding parts of the electrodes are each attached in the center opening of the sealing body by sintering. In the case of using the electrical insertion body as claimed in the invention for a tube lamp for a halogen lamp with a tungsten filament an upholding part of the electrode is not attached in the center opening of the sealing body by sintering, but inner lead pins with tips which are connected to the ends of the tungsten filament are each attached in the center opening of the sealing body by sintering.

In FIG. 1 an arc tube 11 of fused silica glass has a spherical or an oval center region in which there are an anode 20 and a cathode 30 of tungsten opposite one another at a distance of for example 5 mm and xenon gas with a stipulated pressure is added as the discharge gas. Sealing tubes 12, 12 are connected to the two ends of the arc tube 11. The end of the respective sealing tube 12 is sealed with an electrical insertion body 70 for a tube lamp which consists of a sealing body 50 of functional gradient material and an upholding part 40 of the electrode, the functional gradient material consisting of an electrically conductive inorganic material component and a dielectric inorganic material component.

The sealing body 50 is installed in the sealing tube 12 such that one dielectric face side 51 runs in the direction to the arc tube 11, and is welded on this face side 51 to the sealing tube 12 of fused silica glass. Reference number 40 labels the upholding part of the electrode. The upholding part 40 of the electrode of the anode 20 and the upholding part 40 of the electrode of the cathode 30 consist of tungsten. The dielectric face side 51 of the sealing body 50 consists for example of roughly 100% silicon dioxide. Reference number 52 labels an electrically conductive face which has a composition of 25% $SiO_2$+75% Mo.

The functional gradient material of silicon dioxide and molybdenum is completely sintered at roughly 1750° C. By a coating of the upholding part 40 of the electrode with a diffusion accelerator or by the fact that the sealing bodies 50 formed from the functional gradient material contain a diffusion accelerator, the diffusion accelerator at the sintering temperature together with the electrically conductive inorganic material which forms the sealing body 50 forms a solid solution and is melted.

This molten solid solution diffuses into the metallic component of the upholding parts 40 of the electrodes. In this way in the interface region between the upholding part 40 of the electrode and the inside of the center opening of the sealing body 50 an area is formed in which the electrically conductive inorganic material component which forms the sealing body 50, the diffusion accelerator and the metallic component of the upholding part 40 of the electrode are present diffused into one another. The upholding part 40 of the electrode and the inside of the center opening of the sealing body 50 are thus securely joined to one another and attached.

This prevents a high pressure gas within the arc tube 11 from leaking between the upholding part 40 of the electrode and the sealing body 50 or the upholding parts 40 of the electrodes from falling out. The reliability of the connection sites is therefore increased. Therefore it is no longer necessary to apply glass or brazing filler metal as a deposit to the face side 52 of the sealing body 50 from which the upholding part 40 of the electrode projects, as was conventionally the case. In this way the working process can be simplified.

Figure 2:
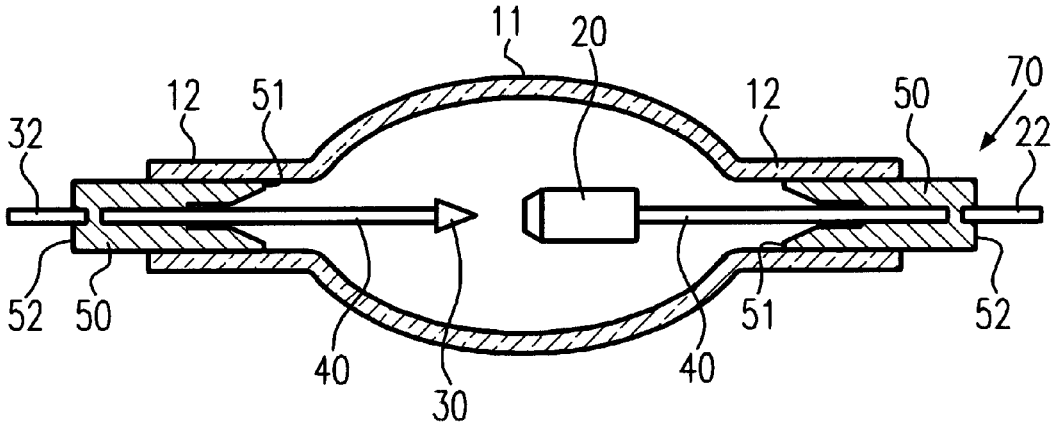
FIG. 2 shows a schematic of another high pressure discharge lamp in which sealing parts of the arc tube are sealed in sealing bodies of a functional gradient material by electrical insertion bodies for a tube lamp in which upholding parts of the electrodes are held without penetration.

Alternatively, as is shown in FIG. 2, the two face sides 51 and 52 of the sealing body 50 can each be provided with a center opening which is not continuous and extends as far as the electrically conductive area. The upholding part 40 of the electrode of the anode 20, the upholding part 40 of the electrode of the cathode 30, an anode terminal 22 and a cathode terminal 32 can be electrically connected to the respective center opening. In this case as well by a coating of the upholding part 40 of the electrode with a diffusion accelerator or by the fact that the sealing bodies 50 formed from the functional gradient material contain a diffusion accelerator, the diffusion accelerator together with the electrically conductive inorganic material which forms the sealing body 50 forms a solid solution and is melted.

In this way in the interface region between the upholding part 40 of the electrode and the inside of the center opening of the sealing body 50 an area is formed in which the electrically conductive inorganic material component which forms the sealing body 50, the diffusion accelerator and the metallic component of the upholding part 40 of the electrode are present diffused into one another. The upholding part 40 of the electrode and the inside of the center opening of the sealing body 50 are thus securely joined to one another and attached.

In the following the preferred embodiment of the invention described in claim 2 is described in which a process for producing the electrical insertion body which is described in claim 1 for a tube lamp is described.

The electrically conductive inorganic material component and the dielectric inorganic material component of the functional gradient material consist for example of a molybdenum powder with an average grain size of 1.0 micron and a silicon dioxide powder with an average grain size of 5.6 microns. As the first process several powder mixtures are formed in which the mixing ratio of the molybdenum powder to the silicon dioxide powder was changed.

Besides the above described silicon dioxide powder, a powder of the corresponding ceramic can also be used as the dielectric inorganic material component of the functional gradient material when the arc tube consists of ceramic. That is, it is enough if it consists of the same material as the arc tube. It goes without saying that for the electrically conductive inorganic material component of the functional gradient material, besides molybdenum powder, a suitable powder of a conductive metal such as nickel, tungsten or the like can be used.

As the second process these powder mixtures are mixed with an organic binder, for example a stearic acid solution of roughly 23%, and are dried. A cylindrical casting mold which has a projecting component for a center opening is filled with these mixtures. In the case of a functional gradient material the casting mold is filled with the powder mixtures such that the mixing ratio of the molybdenum powder to the silicon dioxide powder changes gradually. The cylindrical casting mold is pressed from the outside for example with a load of 1.5 t/cm$^2$. Thus a columnar compact is obtained in which a center opening is formed.

As the third process the resulting compact is sintered in a hydrogen atmosphere at 1200° C. for 30 minutes. Thus the organic binder is eliminated and a temporarily sintered body is obtained.

As the fourth process, on the surface of the respective upholding part of the electrode for example a chromium layer is formed as the diffusion accelerator. The chromium layer is formed by a galvanization process, a process of dipping into a powder, a sputtering process or the like. This thickness of the chromium layer can be for example roughly 30 microns.

Chromium is a metal which forms a 100% solid solution for example both with tungsten which is selected as the upholding part of the electrode and also with molybdenum which is selected as the electrically conductive inorganic material component of the functional gradient material at a sintering temperature of 1750° C. and is therefore active as a diffusion accelerator.

The diffusion accelerator is not limited to chromium. It is enough if it diffuses at the sintering temperature both into the upholding parts of the electrodes and also into the electrically conductive inorganic material component of the sealing body and in this way at the same time accelerates diffusion of the metallic component of the upholding part of the electrode and the electrically conductive inorganic material component of the sealing body into one another, if furthermore in this way in the respective interface area between the upholding part of the electrode and the sealing body an area is formed in which diffusion into one another takes place and when the upholding parts of the electrodes and the sealing bodies are reliably joined to one another and are attached.

The element which was selected as the diffusion accelerator at the temperature for complete sintering of 1750° C. is dissolved in molybdenum as the electrically conductive inorganic material component of the sealing body and in tungsten as the metallic component of the upholding part of the electrode at least to 5 at %. Since its melting point is relatively lower than that of molybdenum which acts as an electrically conductive inorganic material component, and than that of tungsten which acts as the main material component of the electrically conductive inorganic material of the upholding parts of the electrodes, the element is a metal which diffuses far into it.

In the example of molybdenum as the electrically conductive inorganic material component which forms the sealing bodies, Cr, Al, Co, Fe, Ni, Hf, Ir, Nb, Os, Pt, Pd, Ru, Rh, Si, Ti, V, Ta, Zr, Re or the like or an alloy thereof can be used as the diffusion accelerator as the metallic element.

As the fifth process the upholding part 40 of the electrode with a layer of diffusion accelerator formed on its surface is inserted into the center opening of the temporarily sintered body. As is shown in FIG. 3, a state is obtained in which between the inner peripheral surface of the center opening of the sealing body 50 and the outer peripheral surface of the upholding part of the electrode there is a diffusion accelerator 60.

Then sintering continues at 1750° C. for 10 minutes in a nonoxidizing atmosphere or in a vacuum of roughly $10^{-2}$ Pa.

Mainly chromium at a temperature of greater than or equal to 1677° C. is 100% dissolved in molybdenum and also in tungsten when an assessment is made from a phase diagram of the chromium-molybdenum base and the chromium-tungsten base. The phase of the solid solution is also preserved at a lower temperature if the cooling rate in practice is high. Therefore no cavity is formed. Since the sintering temperature of 1750° C. has approached the melting point of chromium, the diffusion coefficient of tungsten and of molybdenum in chromium is extremely good.

Figure 3:
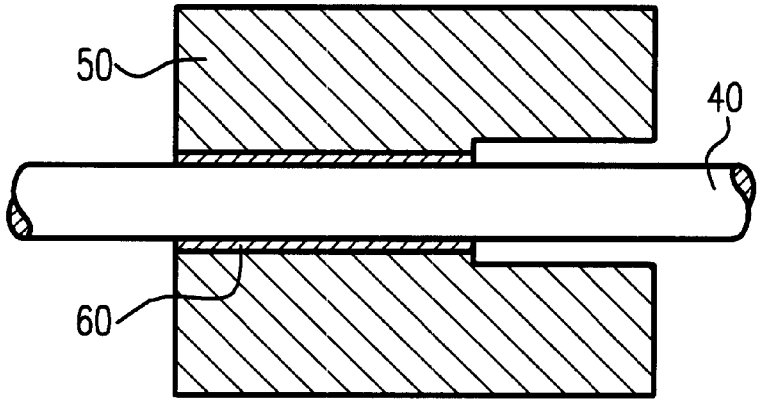
FIG. 3 shows a schematic of important parts of the electrical insertion body and process of the present invention.
Figure 5:
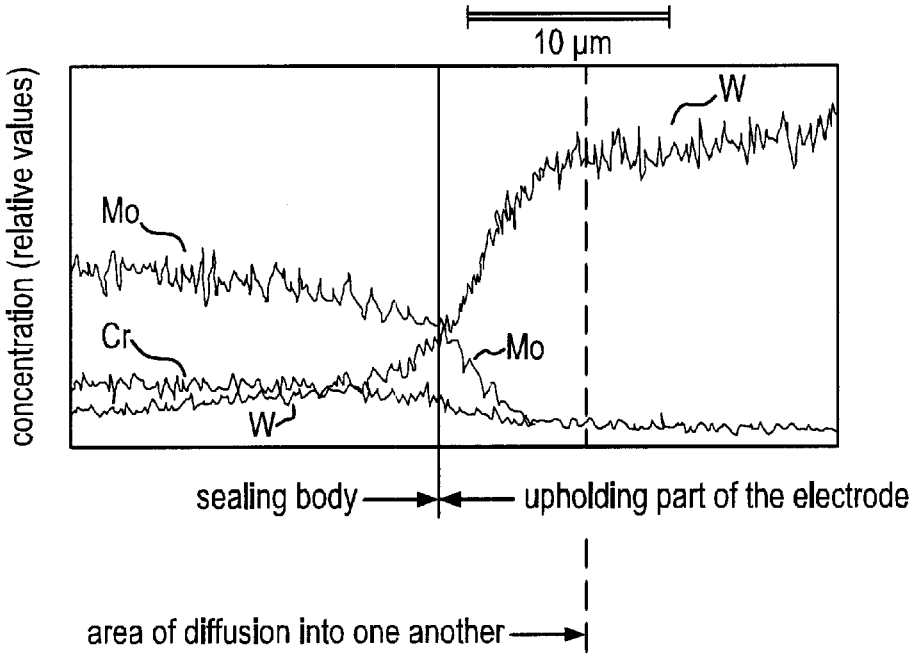
FIG. 5 shows a schematic of the result of EDX analysis of the joining site between a sealing body and an upholding part of the electrode in an embodiment of the invention in which a diffusion accelerator is used.

Since at the sintering temperature a constant time was maintained and cooling was done, the chromium of the diffusion accelerator 60 which is shown in FIG. 3 has diffused into the molybdenum of the sealing bodies 50 and tungsten of the upholding parts 40 of the electrodes as shown in FIG. 5; this is also described below. The molybdenum of the sealing body 50 has at the same time diffused into the chromium of the diffusion accelerator 60 and also into the tungsten of the metallic component of the upholding parts 40 of the electrodes. The tungsten as the metallic component of the upholding parts 40 of the electrodes has diffused also into the chromium of the diffusion accelerator 60 and into the molybdenum of the sealing body 50.

As a result thereof, a state is obtained in which the molybdenum as the electrically conductive inorganic material component and the tungsten as the metallic component of the upholding parts of the electrodes are well diffused into one another. Thus a well joined sealing body can be obtained.

The chromium as the diffusion accelerator together with the molybdenum as the electrically conductive inorganic material component which forms the sealing bodies 50 forms a solid solution and is melted. The melted solid solution diffuses by flowing into the tungsten which forms the upholding parts 40 of the electrodes. In this way an area is formed in which the molybdenum as the electrically conductive inorganic material component which forms the sealing bodies 50, the chromium as the diffusion accelerator and the tungsten of the upholding parts 40 of the electrodes are present diffused into one another. Thus the upholding parts 40 of the electrodes are joined to the sealing bodies 50.

In the following an experimental example is described for confirmation of the action of the invention.

15% by weight silicon dioxide and 85% by weight molybdenum were homogeneously mixed with one another and formed into a column. This sealing body was provided with a continuous center opening and was penetrated with a tungsten upholding part of the electrode with a diameter of 3 mm which was subjected to chromium galvanization in a width of 5 mm and a thickness of 30 microns. Thus a sample of an electrical insertion body for a tube lamp was made available. This sample was sintered for 10 minutes in a vacuum atmosphere at 1750° C. and cut in a cross section in the axial direction which comprises the tungsten upholding part of the electrode. This cut surface was subjected to EDX analysis (energy scattering x-ray spectral method).

FIG. 5 shows the result of EDX analysis. As becomes apparent from FIG. 5, the tungsten (W) of the upholding part of the electrode of tungsten and molybdenum (Mo) as the electrically conductive inorganic material component of the sealing body are diffused into one another in the diffusion region and joined. The tungsten upholding part of the electrode and the inside of the center opening of the sealing body were thus securely joined to one another.

Figure 6:
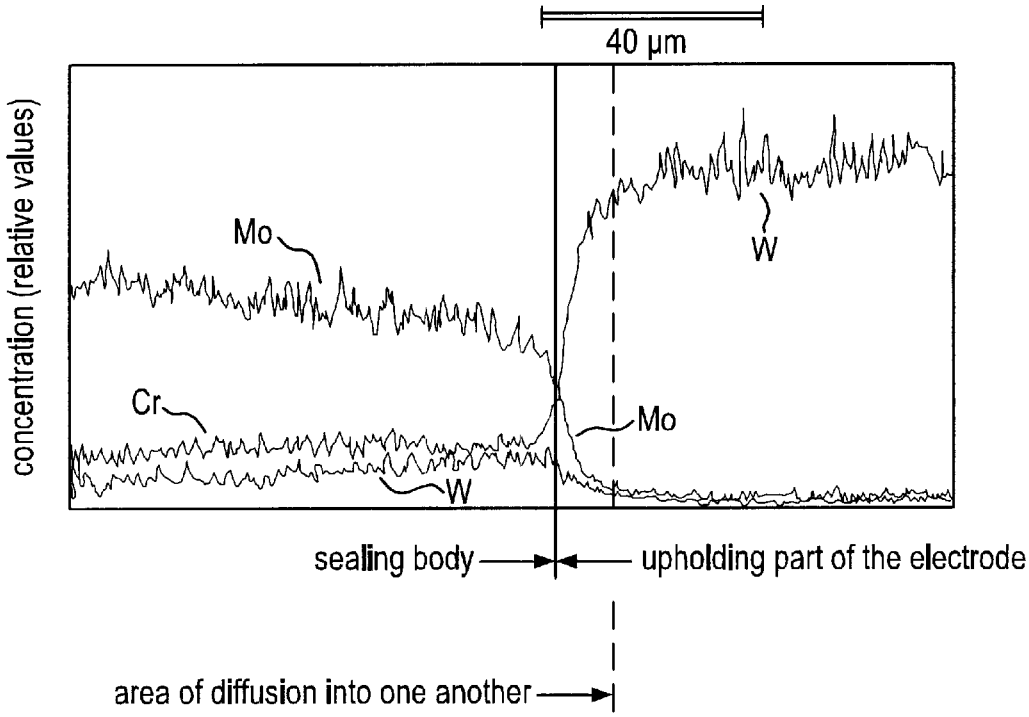
FIG. 6 shows a schematic of the result of EDX analysis of the joining site between a sealing body and an upholding part of the electrode in an embodiment of the invention in which a diffusion accelerator is used.

In the area which was subjected to chromium galvanization, tungsten and molybdenum were diffused into one another by greater than or equal to 10 microns. As becomes apparent from FIG. 6, chromium was also diffused in onto the side of the upholding part of the electrode by roughly 10 microns and onto the side of the sealing body by roughly 100 microns.

Furthermore, observation was done by electron microscope photographs. Here it was confirmed that between the tungsten upholding part of the electrode and the sealing body there was no longer any boundary and the two were securely attached to one another.

Figure 4:
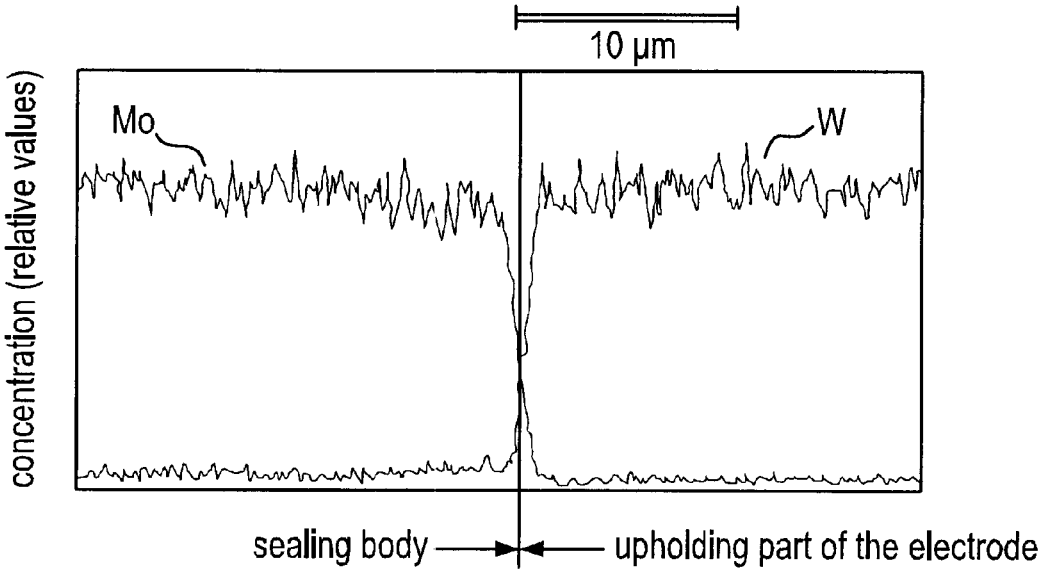
FIG. 4 shows a schematic of the result of EDX analysis of the joining site between a sealing body and an upholding part of the electrode in the conventional case that a diffusion accelerator is not used.

Furthermore, for comparison purposes under the same conditions as in chromium galvanization the upholding part of the electrode was joined to the sealing body without chromium galvanization having been done. FIG. 4 shows the result of EDX analysis here. As became apparent from FIG. 4, hardly any diffusion of the tungsten and the molybdenum into one another was found when chromium galvanization was not done, i.e. when there was no diffusion accelerator.

In the present invention, using a cylindrical casting mold with a projecting component for a center opening a compact with a center opening is obtained. In one embodiment of the present invention, described in claim 3 the outer peripheral surface of the respective upholding part 40 of the electrode is coated with a diffusion accelerator. Here the upholding part 40 of the electrode is placed in the middle of the cylindrical casting mold. The cylindrical casting mold is filled with powder mixtures which have been formed by mixing with an organic binder and pressed from the outside. Thus a compact is obtained which is formed integrally with the upholding part 40 of the electrode.

In the following, one embodiment of the invention is described.

Several first powder mixtures are produced in which an electrically conductive inorganic material component, for example molybdenum powder, and a dielectric inorganic material component such as silicon dioxide powder are mixed with different mixing ratios to one another. Powder as the diffusion accelerator, for example nickel, is mixed with at least one type of the first powder mixtures with a volumetric ratio of for example 5%, yielding a second powder mixture.

Next, the first powder mixtures and the second powder mixtures are mixed individually with an organic binder. A cylindrical casting mold which has a projecting component for a center opening is filled with the first powder mixtures such that the ratio of the molybdenum powder to the silicon dioxide powder changes gradually. The casting mold is next filled with second powder mixtures and then filled with the first powder mixtures such that likewise the ratio of the molybdenum powder to the silicon dioxide powder changes gradually. Thus a powder layer structure is obtained. The cylindrical casting mold is pressed from the outside. This yields a compact consisting of many layers.

FIG. 7 shows one example of the mixing ratio (% by weight) of the powder and the thickness of the respective layer.

The above described compact is temporally sintered, yielding a temporarily sintered body. Next (fifth process) the upholding part 40 of the electrode is inserted into the center opening of the temporally sintered body obtained in the fourth process and completely sintered.

Figures 9, 10:
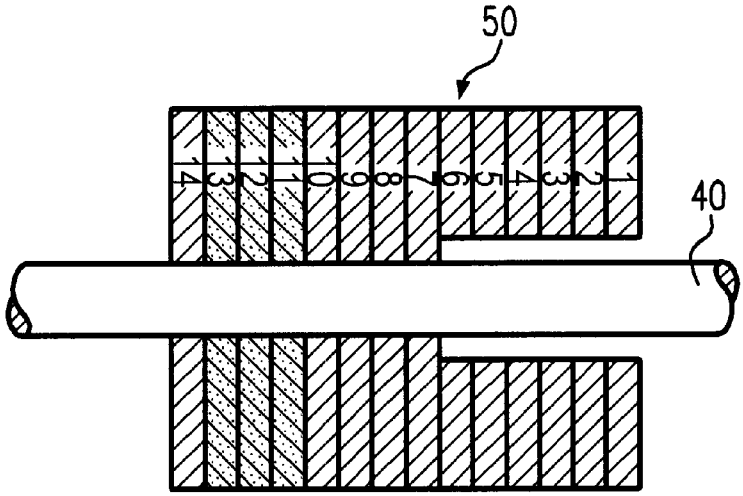
FIG. 9 shows a schematic of important parts of the electrical insertion body and process of the present invention.
FIG. 10 shows a table of one example of the mixing ratio (% by weight) of the respective powders to one another and the thickness (mm) of the respective layer in the case in which chromium is used as the diffusion accelerator.

When using a functional gradient material with the mixing ratios shown in FIG. 7 the sealing body 50 consists of 12 layers as is shown in FIG. 9. The first layer contains only silicon dioxide, while the second to eighth layers and the twelfth layer consist of mixtures of silicon dioxide and molybdenum which were formed from the first powder mixtures.

The ninth to eleventh layers on the other hand are mixtures of silicon dioxide, molybdenum and nickel which were formed from the second powder mixtures. The layers have different thicknesses as is shown in FIG. 7. However they are feasibly shown in FIG. 9 with the same thickness. This temporarily sintered body is sintered for 10 minutes in a nonoxidizing atmosphere or in a vacuum of roughly $10^{-2}$ Pa at 1750° C.

By this complete sintering the nickel contained in the ninth to the eleventh layers together with the molybdenum which forms the sealing body 50 forms a solid solution and is diffused in onto the side of the upholding part 4 of the electrode. In this way an area is formed in which tungsten, molybdenum and nickel are diffused into one another and joined.

The same result as in FIG. 5 is also obtained in EDX analysis. This means that in the diffusion region the tungsten of the tungsten upholding part of the electrode and the molybdenum are diffused into one another and joined. The upholding part 40 of the electrode and the inside of the center opening of the sealing body 50 are attached securely to one another. This is caused by the diffusion acceleration action of nickel.

Furthermore, observation was done by electron microscope photographs. In this case it was also confirmed that between the upholding part 40 of the electrode and the sealing body there was no longer any boundary and the two were securely attached to one another.

Therefore this prevents leakage of high pressure gas from the boundary between the upholding part 40 of the electrode and the sealing body 50 during operation.

The mixing ratio of nickel to molybdenum in FIG. 7 is 5% by weight. However the mixing ratio of the nickel to the molybdenum was changed and these mixing ratios and the degree of formation of leaks were studied. FIG. 8 shows the result.

As becomes apparent therefrom, at a mixing ratio of nickel of 5% by weight and 10% by weight no leak occurs while at a mixing ratio of nickel of 3% by weight and 20% by weight the probability of a leak increases.

The reason for this is that at a mixing ratio of nickel of 3% by weight the amount of nickel is too small and an area for sufficient diffusion into one another is not formed. At a mixing ratio of nickel of 20% by weight the solution boundary of nickel and molybdenum into one another is great at 1750° C. Since however in the cooling process excess molybdenum or excess nickel precipitates or a third phase forms, in the alloy there remains a cavity from which presumably a leak occurs.

In the present invention, a cylindrical casting mold with a projecting component for a center opening is used and a compact with a center opening is obtained. But it is also possible to proceed as follows:

The upholding part 40 of the electrode is placed in the middle of the cylindrical casting mold. The cylindrical casting mold is gradually filled with first and second powder mixtures which have been mixed with an organic binder. The cylindrical casting mold is pressed from the outside. Thus a compact is obtained which is formed integrally with the upholding part 40 of the electrode.

The present invention was described above using one embodiment in which nickel is used as the diffusion accelerator. A case of using chromium as the diffusion accelerator is described below.

Several first powder mixtures are produced in which an electrically conductive inorganic material component, for example molybdenum powder, and a dielectric inorganic material component such as silicon dioxide powder, are mixed with different mixing ratios to one another. Chromium powder as the diffusion accelerator is mixed with at least one type of the first powder mixtures with a volumetric ratio of for example 5%, yielding second powder mixtures.

Next, the first powder mixtures and the second powder mixtures are mixed individually with an organic binder. A cylindrical casting mold is filled with the first powder mixtures such that the ratio of the molybdenum powder to the silicon dioxide powder changes gradually. The casting mold is next filled with the second powder mixtures and then filled with the first powder mixtures such that likewise the ratio of the molybdenum powder to the silicon dioxide powder changes gradually. Thus a powder layer structure is obtained. The cylindrical casting mold is pressed from the outside. This yields a compact consisting of many layers.

FIG. 10 shows one example of the mixing ratio (% by weight) of the powder and the thickness of the respective layer.

The above described compact is temporally sintered, yielding a temporarily sintered body. The upholding part 40 of the electrode is inserted into the center opening of the temporally sintered body.

When using a functional gradient material with the mixing ratios shown in FIG. 10 the sealing body 50 consists of 12 layers. The first layer contains only silicon dioxide, while the second to eighth layers and the twelfth layer consist of mixtures of silicon dioxide and molybdenum which were formed from the first powder mixtures.

The ninth to eleventh layers on the other hand are mixtures of silicon dioxide, molybdenum and chromium which were formed from the second powder mixtures. This temporarily sintered body is completely sintered for 10 minutes in a nonoxidizing atmosphere or in a vacuum of roughly $10^{-2}$ Pa at 1750° C.

By this complete sintering the chromium contained in the ninth to the eleventh layers together with the molybdenum which forms the sealing body 50 forms a solid solution and is diffused in onto the side of the upholding part 4 of the electrode. In this way an area is formed in which tungsten, molybdenum and chromium are diffused into one another and joined.

The same result as in FIG. 5 is obtained also in EDX analysis in this case. This means that the tungsten of the tungsten upholding part of the electrode and the molybdenum are diffused into one another in the diffusion area and joined. The upholding part 40 of the electrode and the inside of the center opening of the sealing body 50 are attached securely to one another. This is caused by the diffusion acceleration action of chromium.

Furthermore, observation was done by electron microscope photographs. In this case it was also confirmed that between the upholding part 40 of the electrode and the sealing body 50 there was no longer any boundary and the two were securely attached to one another.

Therefore this prevents leakage of high pressure gas from the boundary between the upholding part 40 of the electrode and the sealing body 50 during operation.

COMMERCIAL APPLICATION

As was described above, in the interface area between the inner peripheral surface of the center opening of the sealing body of functional gradient material; which consists of a electrically conductive inorganic material component and a dielectric inorganic material component, and the outer peripheral surface of the upholding part of the electrode, an area is formed in which the electrically conductive inorganic material component, the diffusion accelerator and the dielectric inorganic material component are diffused into one another. The upholding part of the electrode and the electrically conductive inorganic material component of the sealing body are thus joined to one another.

In this way the inside of the center opening of the sealing body and the upholding part of the electrode are attached securely to one another. This prevents leakage or the upholding parts of the electrodes from falling out. The reliability of the joining site of the upholding part of the electrode is therefore greatly increased.

Thus an electrical insertion body for a tube lamp is obtained which is suitable for sealing the sealing tubes of a tube lamp, such as a mercury lamp, a metal halide lamp, a halogen lamp or the like.

What we claim is:

1. An electrical insertion body for a tube lamp for hermetic sealing of sealing tubes connected to an arc tube of the tube lamp, in which one upholding part of an electrode is inserted into a center opening of a respective sealing body formed of a functional gradient material which includes an electrically conductive inorganic material component and a dielectric inorganic material component and which is shaped in the form of a multilayer column such that the ratio of the electrically conductive inorganic material component and the dielectric inorganic material component changes gradually in the axial direction, comprising:

a diffusion area formed in the boundary areas between the sealing body and the upholding part of the electrode, said diffusion area including a diffused combination of the electrically conductive inorganic material component which forms the sealing body, a metallic component of the upholding part of the electrode and a diffusion accelerator, the diffusion area adapted to accelerate diffusion of the electrically conductive inorganic material component which forms the sealing body and of the metallic component of the upholding part of the electrode at a sintering temperature of the functional gradient material to cause joining of the upholding part of the electrode and an inside portion of the center opening of the sealing body.

2. A process for producing an electrical insertion body for a tube lamp, comprising the steps of:

mixing an electrically conductive inorganic material component with a dielectric inorganic material component to produce powder mixtures;

mixing said powder mixtures with an organic binder;

filling a cylindrical casting mold with the mixture of said powder mixtures and said organic binder, said casting mold including a projecting component for forming a center opening;

pressing the cylindrical casting mold from the outside to form a compact;

temporarily sintering said compact to form a temporarily sintered body;

coating an outer peripheral surface of an upholding part of an electrode with a diffusion accelerator;

inserting the upholding part of the electrode into the center opening of the temporarily sintered body; and completely sintering the temporarily sintered body to cause joining of the upholding part of the electrode and an inside portion of the center opening of the completely sintered body.

3. A process for producing an electrical insertion body for a tube lamp, comprising the steps of:

mixing an electrically conductive inorganic material component with a dielectric inorganic material component to produce powder mixtures;

coating an outer peripheral surface of an upholding part of an electrode with a diffusion accelerator;

placing the upholding part of the electrode in a center of a cylindrical casting mold;

mixing said powder mixtures with an organic binder;

filling a cylindrical casing mold with the mixture of said powder mixtures and said organic binder;

pressing the cylindrical casting mold from the outside to form a compact;

temporarily sintering said compact to form a temporarily sintered body; and completely sintering the temporarily sintered body to cause joining of the upholding part of the electrode and an inside portion of a center opening of the completely sintered body.

* * * * *